United States Patent [19]

Morris

[11] 4,300,743

[45] Nov. 17, 1981

[54] MUSIC STAND TRAY ACCESSORY

[75] Inventor: Earl R. Morris, San Diego, Calif.

[73] Assignee: Eric Beheim, San Diego, Calif.

[21] Appl. No.: 106,691

[22] Filed: Dec. 26, 1979

[51] Int. Cl.[3] ..... A47B 19/00; A47B 97/04

[52] U.S. Cl. ..... 248/441 R; 248/460

[58] Field of Search ..... 248/441 R, 460; 297/135; 312/233

[56] References Cited

U.S. PATENT DOCUMENTS 513,113 1/1894 Kelly ..... 248/441 R 3,467,259 9/1969 Silver ..... 248/460

4,057,215 11/1977 Stettler ..... 248/460

*Primary Examiner*—Patrick D. Lawson

*Attorney, Agent, or Firm*—Henri J. A. Charmasson

[57] ABSTRACT

An accessory removably mounted on a sheet music support stand is provided for musicians to accommodate accessories to musical instruments as well as other varied paraphernalia for which no convenient temporary storage place is provided when the musician is playing. In modified form, the accessory tray is separable into three elongated, compact parts easily transported in a separate custom-made carrying bag or together with a collapsible music stand.

9 Claims, 11 Drawing Figures

MUSIC STAND TRAY ACCESSORY

BACKGROUND OF THE INVENTION

Most people carry a variety of paraphernalia with them such as keys, nail clippers, wallets, glasses and other small objects which are bulky and tend to distend the pockets when carried in that fashion. In addition to these articles, musicians have a variety of accessories accompanying their instruments which must be accessible periodically, or regularly, when they play. In an orchestral setting or even when practicing, no such place currently exists and the musician may keep reeds, extra mouthpieces, resin, a reed knife, mutes, guitar picks, extra strings, a tuning form or castanettes (not usually all of the above), stewn about the chair in which the musician sets or resting on the sheet music stand, thereby interferring with the sheet music.

Clearly, musicians thus have a need beyond that of the average person for convenient temporary storage of their accessories in a fashion that makes they readily available for use with their instruments while playing.

SUMMARY OF THE INVENTION

The present invention fulfills the above-mentioned need by providing a specially designed tray specifically adapted to attach to the front support ledge of a music stand. These stands, often of the portable type, have an oblique front ledge which supports the bottom of the sheet music, and over this ledge is engaged a slotted bar with a depending tray element connector which support an accessory tray element in horizontal relation. The tray element has a peripheral rib in its preferred embodiment and may also have an opening therethrough through which the body of a reed soaker vessel may be engaged.

In its most portable form, the ledge-engaging bar defines an underlying track slidably and removably engaging the tray element connector which in turn defines a slot removably accommodating the planar tray element, so that these three portions of the device are separable and arranged in parallel fashion for convenient carrying in a specially designed carrying case.

DETAILED DESCRIPTION OF THE PREFERRED EMBODIMENTS

Figure 1:
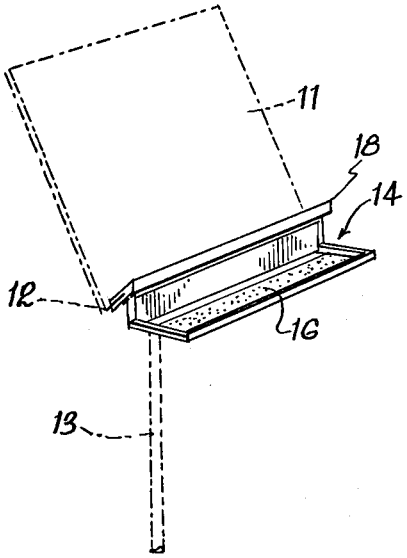
FIG. 1 is a perspective view of the first embodiment of the device in place on a music stand.
Figure 2:
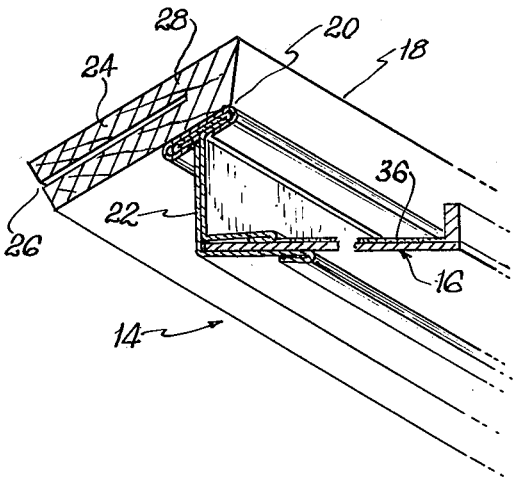
FIG. 2 is a perspective of a detail of the embodiment of FIG. 1.

A typical music stand is pivotally shown in dotted lines at 10 in FIG. 1 and includes rear support surface 11 against which the sheet music lays, the lower support ledge 12 which supports the bottom of the sheet music, and the support shaft 13. These music stands come in a variety of different forms, some of which are portable, having a rear surface 11 defined by a planar array of pivotal rods, others being illuminated and so forth. However, one thing they all have in common, at least the type referred to here, is the generally upright reclining rear surface defining member 11 and the ordinarily orthogonally extended support ledge 12.

Figure 3:
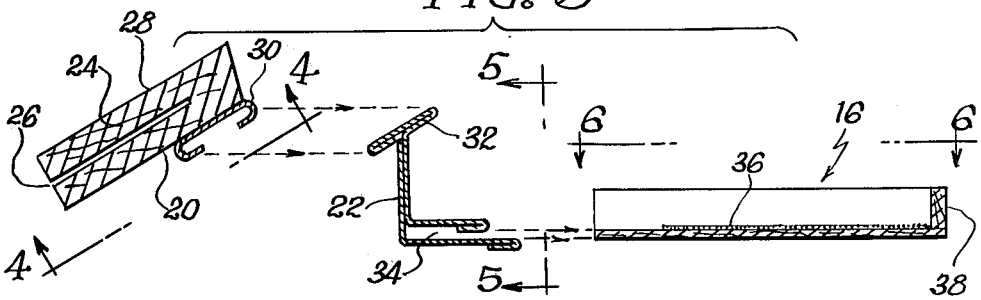
FIG. 3 is an exploded lateral sectional view illustrative of the three parts into which the tray assembly separates for portage.
Figure 4:
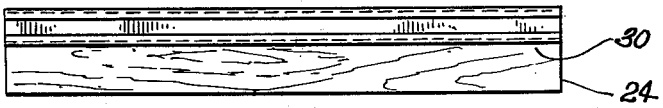
FIG. 4 is a view taken along line 4—4 of FIG. 3.
Figure 5:
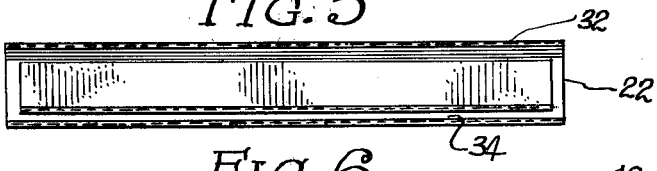
FIG. 5 is a view taken along line 5—5 of FIG. 3.
Figure 6:
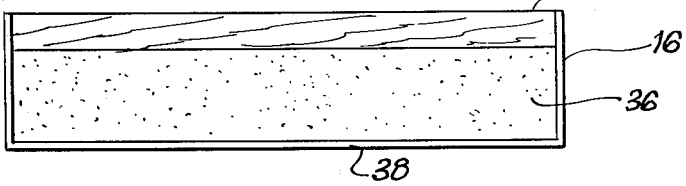
FIG. 6 is a view taken along line 6—6 of FIG. 3.

The accessory tray of the present invention in both the embodiments illustrated herein are adapted to engage the support tray 12. The first embodiment, indicated at 14, is dismantleable and comprises horizontal tray element 16 which is engaged on the support ledge 12 by means of clamping means 18. The clamping means is in turn comprised of a ledge-engaging element 20 and a connector 22 which attaches members 20 and 16. In the first embodiment, members 16, 20 and 22 are separable for portability as indicated in FIG. 3, and can be conveniently carried in their own specially designed case or may be combined with the collapsed music stand 10 and all carried together.

Turning to the details of the first embodiment, the ledge-engaging element 20 comprises an elongated bar 24 of wood, or the like, having a longitudinally extended rearwardly entrance slot 26 which slips over the support ledge 12 to engage the music stand. Note that this bar defdines an expanded upper surface 28 of greater area than the support ledge 12, thereby providing more space to accommodate sheet music or the musician's accessories.

In the first embodiment, the bottom surface of the bar 24 defines a longitudinal track 30 into which is slidably accepted the rail 32 of the connector member 22. The track 30 and the connector 22 ordinarily would be made of sheet metal and the latter at its lower end defines a pair of opposed parallel panels defining interior slot 34 into which is laterally slid the rear edge of the tray element 16. The tray element is preferably covered with felt 36 or like padding and defines a peripheral retaining rib 38. To assemble the entire assembly, rail 32 is slid into track 30, tray 16 laterally slides into slot 34 and the entire accessory tray is mounted by virtue of slot 26 onto the music stand.

Figure 7:
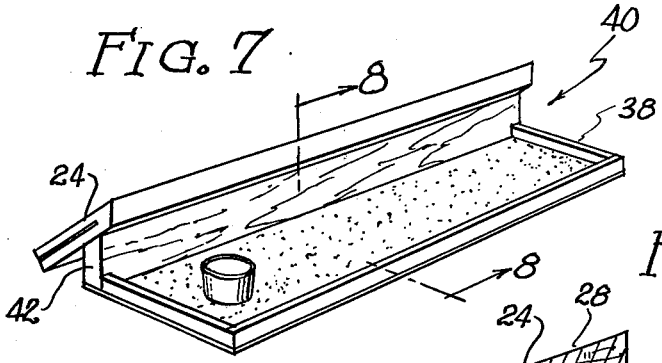
FIG. 7 is a perspective view of a slightly modified form of the invention which is unitary.

A rigid, non-separable embodiment is shown in FIG. 7 at 40 which utilizes the same bar 24 and tray element 16 but rather than the removable features associated with the connector 22 in the first embodiment, a simple rigidly connected upright 42 connects the ledge-engaging element to the tray element. Other features remain the same except for optional aperture 44 which is used to seat a reed soaker vessel 46. The upright 44 can be made of wood lending to a simpler construction than the previous embodiment, as exemplified by the nail construction indicated at 48.

Figure 8:
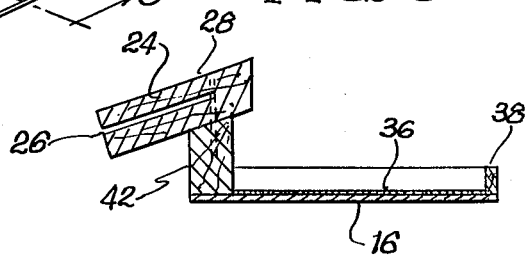
FIG. 8 is a section taken along line 8—8 of FIG. 7.
Figure 9:
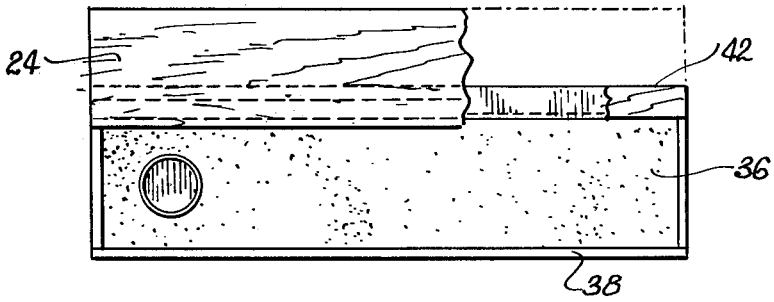
FIG. 9 is a top elevation view of the embodiment of FIG. 7 with portions cut away.
Figure 10:
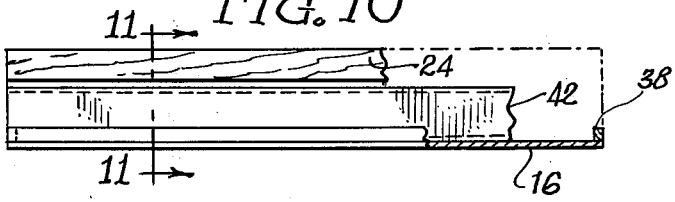
FIG. 10 is a front elevation view of the embodiment of FIG. 7 with portions cut away.
Figure 11:
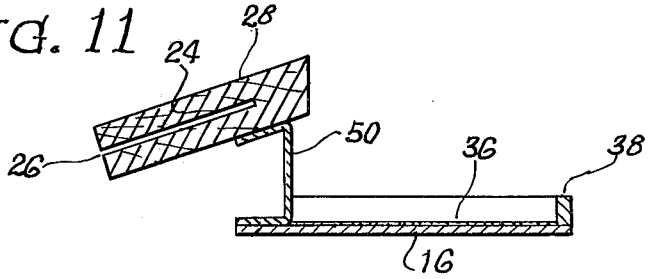
FIG. 11 is a section taken along line 11—11 of FIG. 10.

Yet another slight modification of the embodiment illustrated in FIGS. 7 and 8 is indicated in FIGS. 9 through 11 wherein the above-described upright 42 of wooden construction is replaced by an extrusion or other channel-shaped product of aluminum, plastic, or the like.

In any of its embodiments, the accessory tray is a boon to musicians and fulfills the long-felt otherwise unmet need, and in its portable modification is especially advantageous to the musician. The above embodiments are illustrative only and are of course not intended to restrict the invention to a form narrower than that lent by a fair interpretation of the claims appended below.

What is claimed is:

1. A musical instrument accessory tray for a sheet music stand having a generally upright rear sheet music support member with a forwardly projecting sheet music support ledge, said tray comprising:

a. a tray element;

b. clamping means mounted to said tray element and adapted to securely engage said ledge;

c. said clamping means being dimensioned and oriented relative to said tray element such that when engaged on said ledge, said tray is securely supported substantially horizontally adjacent said ledge.

2. An accessory tray according to claim 1 wherein said clamping means includes a ledge-engaging element defining a planar surface overlying said support ledge and generally parallel thereto and of plan form greater than said ledge to provide an improved underlying sheet music support surface.

3. An accessory tray according to claim 1 wherein said ledge is planar and said clamping means includes a ledge-engaging element comprising an elongated bar having a longitudinal slot therein by which said clamping means engages said ledge.

4. An accessory tray according to claim 1 wherein said clamping means supports said tray element forward and below said ledge and said tray element further defines a peripheral upright retaining rib.

5. An accessory tray according to claim 1 wherein said clamping means and tray element are separable to permit the parallel compact orientation thereof for portability.

6. An accessory tray according to claim 5 wherein said clamping means comprises a ledge-engaging element and a separable tray element connector whereby said accessory tray is separable into three parts for portability.

7. An accessory tray according to claim 6 wherein said ledge-engaging element defines a track and said tray element connector defines a rail slidably keyed into said track.

8. An accessory tray according to claim 7 wherein said tray element is substantially planar and said tray element connector defines a longitudinal slot removably engaged on said tray element.

9. An accessory tray according to claim 4 or claim 8 wherein said tray element defines an opening in its load-carrying surface to accommodate a vessel.

* * * * *